US006592124B1

(12) United States Patent
Hessen

(10) Patent No.: US 6,592,124 B1
(45) Date of Patent: Jul. 15, 2003

(54) BOARD GAME AND METHOD OF PLAY

(76) Inventor: John Van Hessen, 3325 Pine Blvd., Martinsville, IN (US) 46151

( * ) Notice: Subject to any disclaimer, the term of this patent is extended or adjusted under 35 U.S.C. 154(b) by 0 days.

(21) Appl. No.: 10/137,775

(22) Filed: May 3, 2002

(51) Int. Cl.[7] ..... A63F 3/00
(52) U.S. Cl. ..... 273/261; 273/262
(58) Field of Search ..... 273/260, 261, 273/255, 262, 287; D21/348, 388; 463/14

(56) References Cited

U.S. PATENT DOCUMENTS 440,737 A * 11/1890 Burge ..... 273/258
511,773 A * 1/1894 Higgins ..... 273/236
1,392,979 A * 10/1921 Taufer ..... 273/260
D225,245 S * 11/1972 Berger ..... D21/349
4,067,578 A * 1/1978 Chang ..... 273/261
6,082,735 A * 7/2000 Kintner ..... 273/261

* cited by examiner

*Primary Examiner*—Benjamin H. Layno
*Assistant Examiner*—Vishu K Mendiratta
(74) *Attorney, Agent, or Firm*—Daniel J. O'Connor

(57) ABSTRACT

A game board and method of play wherein a particular jumping and capture method are used in accordance with the rules of play. In order to capture an opponent's pawn or playing piece, a player must first jump over his or her own pawn. The game board includes a central jumping zone with related rules of play. The game and methodology of play may be incorporated in computer and internet systems. The basic game rules are easily learned and yet the game requires a high degree of concentration and foresight to accomplish the various capture moves.

4 Claims, 2 Drawing Sheets

BOARD GAME AND METHOD OF PLAY

BACKGROUND AND OBJECTS OF THE INVENTION

The present invention is generally related to the gaming arts and, in particular, to a novel board game and method of play.

Strategy board games related to chess and checkers have been known in the art. Such games require varying degrees of skill and may be difficult to learn in practical applications.

Accordingly, it is an object of the present invention to set forth a new game board and method of play which may be easily learned and which also involves a high degree of skill and thought in practice.

It is a still further object of the invention to demonstrate a game board system which may be economically manufactured for widespread commercial appeal and use in the marketplace. The pieces used in play may comprise, for example, pawn-type playing pieces.

It is also an object of the invention to show a novel board game having unique rules for piece movement, jumping and capturing of an opponent's pieces.

It is a further object of the invention to set forth a game method which may be played by two, four or more players.

These and other objects and advantages of the invention will be apparent to those of skill in the art from the description which follows.

PRIOR ART PATENTS AND DESIGNS

During the course of preparing this specification for submission to the U.S. Patent Office, a full search of the prior art patents and literature was conducted.

U.S. Pat. No. 6,082,735 for a board game teaches a method of play wherein each player utilizes twelve game pieces. The game board has inactive or dead zones at the corners thereof. It does not include the unique jumping zone of the present invention. The cited patent also does not include many of the unique jumping and capture rules of the present invention.

Accordingly, the present design is believed to be patentable over this and all other known patents in the art.

SUMMARY OF THE INVENTION

In a preferred embodiment, the game board comprises thirteen rows and thirteen columns of spaces.

Four starting areas or zones are at the lateral areas of the game board. Each starting area has spaces for twelve playing pieces or pawns.

A central area of the game board has a jumping zone comprising eight spaces of a unique color wherein the spaces are arranged in a generally "X" pattern.

One of the novel rules of play is that a player must first jump one of his or her own pieces before jumping and capturing the pawn or piece of an opponent.

A player must also jump one of his/her own pieces before using the central jumping zone spaces.

The object of the game is to capture all but one of an opponent's pieces or pawns.

BRIEF DESCRIPTION OF THE DRAWING FIGURES

FULL DESCRIPTION OF A PREFERRED EMBODIMENT

Figure 1:
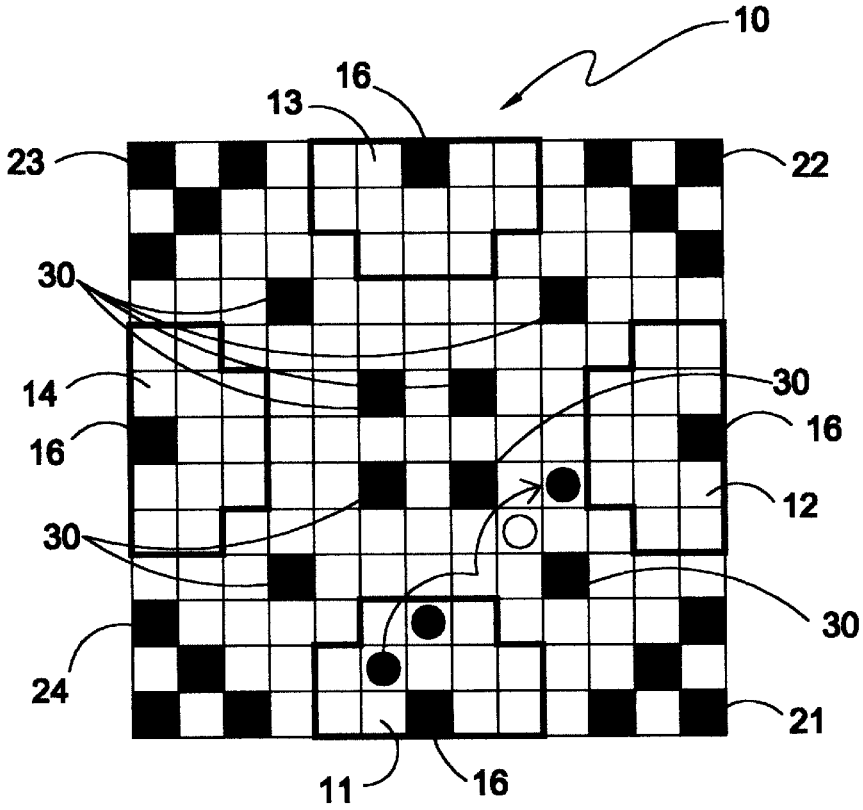
FIG. 1 is a top view of the game board and shows the starting areas, the inactive areas and the central jumping zone. Several pawns or playing pieces are also shown in the lower portion of FIG. 1.

Referring to the drawing FIG. 1, the basic game board 10 is shown having thirteen rows and thirteen columns for a total of 169 spaces.

The board 10 includes four starting areas 11, 12, 13 and 14. Each starting area has twelve spaces for twelve playing pieces or pawns.

The starting areas and the pawns contained therein have different colors to identify each players pieces. For example, starting area 11 is red in color, starting area 12 is yellow, starting area 13 is blue and starting area 14 is green. Spaces 16 may not be jumped over or entered.

The board 10 includes four inactive or dead zones 21, 22, 23 and 24. These zones are not used in play and may not be entered. As shown in FIG. 1, the inactive zones each comprise four spaces at the respective corners of the board.

The board 10 further includes a central jump zone to be further described.

As further shown in FIG. 1, the game board includes a central jump zone comprising eight spaces 30. The jump zone spaces 30 are arranged in a generally "X" pattern or configuration.

The jump zone spaces 30 are used, according to the rules of play, in a manner to be described hereinafter.

Figure 2:
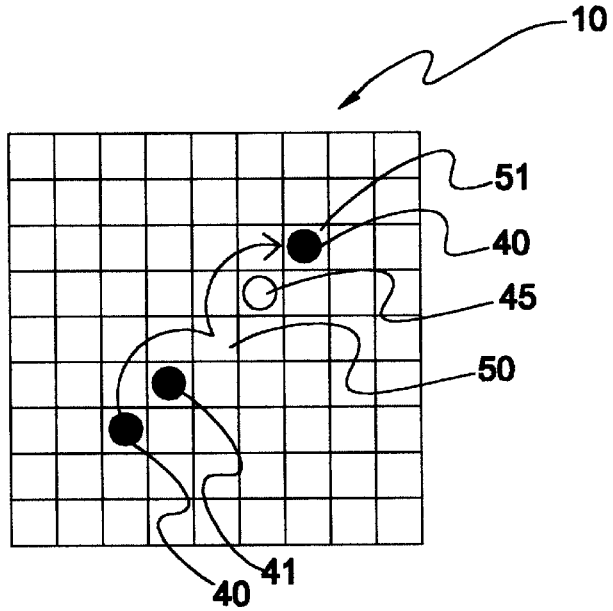
FIG. 2 is an enlarged view of a portion of the playing board and illustrates the method of play wherein a player must first jump over his or her own pawn in order to capture an opponent's pawn.

Several playing pieces or pawns are shown in FIG. 1 and the enlarged view of FIG. 2 shows how the jumping or capture of an opponent's pawn is achieved according to the rules of play.

FIG. 2 shows an opponent's pawn 45 to be jumped or captured. To achieve such capture, a player must first jump over his/her own pawn to an empty space and then jump over the opponent's pawn.

Thus, pawn 40 is jumped over pawn 41 to an empty space 50. Pawn 40 is then jumped over the opponent's pawn 45 and moved to empty space 51.

Captured pawn 45 is then removed from play.

Figure 3:
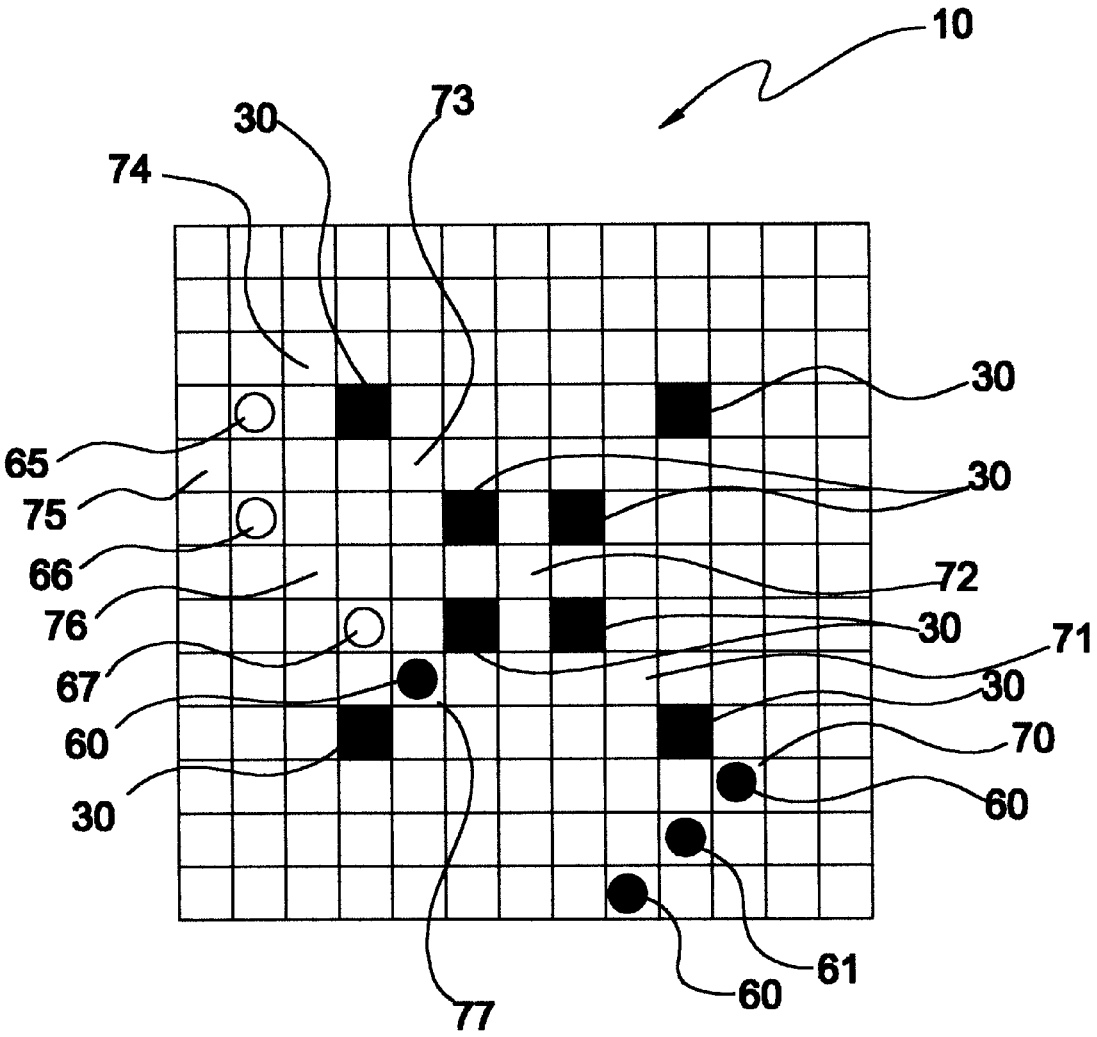
FIG. 3 is a further enlarged view of a portion of the playing board and illustrates how the central jumping zone spaces 30 are advantageously used in accord with the rules of the game.

FIG. 3 illustrates the use of the eight central jump zone spaces 30 which are generally in the shape of an "X" pattern.

In the pawn movement of FIG. 3, the opponent's pawns 65, 66 and 67 are to be captured.

The player's pawn 60 is jumped over his/her own pawn 61 to an empty space 70. Such a jump over one's own pawn must be effected before a player can use the jump zone spaces 30.

The pawn 60 can then be jumped through the jump zone by movement to empty space 71, then to empty space 72, then to empty space 73 and then to empty space 74.

The pawn 60 is then jumped over the opponent's pawn 65 to an empty space 75. Pawn 65 is thus captured and removed from the board.

The pawn 60 is then moved to space 76 to capture piece 66 and finally to space 77 to capture the opponent's piece 67.

Some of the other important rules for the method of play are as follows:

a player can move in any appropriate direction, a player's pawn can only be moved one space at a time unless the pawn is jumping or using the jump zone spaces, a player can perform multiple jumps with his/her own pawns, once the player's hand is removed from the pawn, the turn is over and it is the next player's turn to play even if a jump is missed.

The game can be easily adapted for four player's. For example, in FIG. 1, the red and blue teams of starting areas 11 and 13 would be partners. Also, the yellow and green teams of starting areas 12 and 14 would be partners.

Under the partner playing rules, one can jump over his/her partner's pawns but cannot move the partner's pawns or remove them from the board.

Under further rules of partner play, one cannot advise his/her partner which move to make or which strategy to adopt.

It will thus be appreciated by those of skill in the game arts that the basic rules of the game may be readily learned and yet the game requires a high degree of concentration and foresight regarding capturing maneuvers and defensive strategy.

The game principles described herein may be easily applied to computer systems such as computer discs, computer software or internet usage.

While a particular game board and method of play have been shown and described, it is intended in this specification to cover all equivalent game boards and playing methods which would reasonably occur to those of skill in the art.

The invention is further defined by the claims appended hereto.

I claim:

1. A method of playing a board game using a board(10) having at least two starting areas (11,13) wherein each starting area has twelve spaces therein, wherein said board(10) has inactive corner areas(21,22, 23,24) and a central jumping zone comprising plural spaces means(30) used for jumping movements during the game play, wherein an opponent's piece or pawn(45) may only be jumped and captured by a player's pawn(40) by first jumping the player's own pawn(41) and movement into an empty space(50) and then jumping the opponent's pawn(45) and movement into an empty space(51), wherein to use the jumping zone spaces(30) a piece or pawn(60) must first jump over his/her own piece or pawn(61) and into an empty space(70) which is adjacent to one of said jumping zone spaces(30).

2. The method of claim 1 wherein said central jumping spaces(30) are arranged in a generally X-shaped configuration.

3. The method of claim 2 wherein the central jumping zone comprises eight spaces.

4. The method of claim 3 wherein the board(10) includes four starting areas(11,12,13,14) for use by four players and wherein the board may be used for team play.

* * * * *